US010618240B2

(12) United States Patent
Pessotto et al.

(10) Patent No.: US 10,618,240 B2
(45) Date of Patent: Apr. 14, 2020

(54) METHOD FOR PRODUCTION OF A FEMALE EMBOSSING TOOL, A FEMALE EMBOSSING TOOL, AND AN EMBOSSING MODULE EQUIPPED THEREWITH

(71) Applicant: BOBST MEX SA, Mex (CH)

(72) Inventors: Francesco Pessotto, Le Mont-sur-Lausanne (CH); Roberto Valterio, Ollon (CH)

(73) Assignee: BOBST MEX SA (CH)

( * ) Notice: Subject to any disclaimer, the term of this patent is extended or adjusted under 35 U.S.C. 154(b) by 275 days.

(21) Appl. No.: 15/525,102

(22) PCT Filed: Oct. 29, 2015

(86) PCT No.: PCT/EP2015/025075
§ 371 (c)(1),
(2) Date: May 8, 2017

(87) PCT Pub. No.: WO2016/074798
PCT Pub. Date: May 19, 2016

(65) Prior Publication Data

US 2017/0313018 A1 Nov. 2, 2017

(30) Foreign Application Priority Data

Nov. 10, 2014 (EP) ..... 14003718

(51) Int. Cl.
*B31F 1/07* (2006.01)

(52) U.S. Cl.
CPC ..... *B31F 1/07* (2013.01); *B31F 2201/0702* (2013.01); *B31F 2201/0717* (2013.01);
(Continued)

(58) Field of Classification Search
CPC ..... Y10T 29/4956; Y10T 29/49561; B21B 27/005; B31B 50/59; B31B 50/88; B31D 5/006
See application file for complete search history.

(56) References Cited

U.S. PATENT DOCUMENTS 3,560,289 A 2/1971 Otto et al.
4,084,500 A 4/1978 Brown et al. ..... 101/28
(Continued)

FOREIGN PATENT DOCUMENTS

EP 0 879 197 B1 3/2000
EP 1 932 657 A1 6/2008
(Continued)

OTHER PUBLICATIONS

International Search Report dated Jan. 26, 2016 in corresponding PCT International Application No. PCT/EP2015/025075.
(Continued)

*Primary Examiner* — Jason L Vaughan
(74) *Attorney, Agent, or Firm* — Ostrolenk Faber LLP

(57) ABSTRACT

A method for production of a female embossing tool (6) intended for embossing a sheet element (60): provide a female embossing tool (6) with an outer layer (44) made of a material with shape-memory type properties, and the outer face of the layer has no recesses; provide a male embossing tool (5, 5') with an outer face with at least one protuberance corresponding to at least one desired embossing relief that is to be formed on the sheet element (60) after embossing; and cooperation of the male embossing tool (5, 5') with the female embossing tool (6) such that the outer layer (44) of the female embossing tool (6) undergoes a plastic deformation which creates at least one recess (42, 42') of a shape complementary to the protuberance(s) (41, 41') of the male embossing tool (5, 5').

6 Claims, 6 Drawing Sheets

(52) U.S. Cl.
CPC ..... *B31F 2201/0728* (2013.01); *B31F 2201/0738* (2013.01); *B31F 2201/0743* (2013.01)

(56) References Cited

U.S. PATENT DOCUMENTS

| | | | | | |
|---|---|---|---|---|---|
| 4,603,634 | A * | 8/1986 | Fadner | B41N 7/06 | 101/487 |
| 5,203,761 | A * | 4/1993 | Reichental | B26D 1/185 | 493/346 |
| 5,233,921 | A * | 8/1993 | John | B41F 31/26 | 101/352.13 |
| 6,024,907 | A * | 2/2000 | Jagunich | B29C 37/0003 | 264/210.2 |
| 6,126,013 | A * | 10/2000 | Miller | B65D 81/03 | 206/308.1 |
| 6,308,623 | B1 * | 10/2001 | Schonberger | B41F 31/26 | 101/153 |
| 7,069,756 | B2 * | 7/2006 | Daehn | B21D 26/14 | 29/419.2 |
| 7,188,498 | B2 * | 3/2007 | Browne | B21D 37/01 | 148/402 |
| 7,389,664 | B1 * | 6/2008 | Cheng | B21D 26/14 | 72/56 |
| 7,480,975 | B2 * | 1/2009 | Verbrugge | B23Q 3/086 | 269/310 |
| 7,563,334 | B2 * | 7/2009 | Zhang | C22F 1/006 | 148/563 |
| 7,587,805 | B2 * | 9/2009 | Browne | B23Q 3/062 | 264/219 |
| 7,762,188 | B2 * | 7/2010 | Iftime | B41N 1/00 | 101/368 |
| 7,814,830 | B2 * | 10/2010 | Rene | B41M 1/00 | 101/395 |
| 8,038,923 | B2 * | 10/2011 | Berger | B29C 33/308 | 264/230 |
| 8,266,938 | B2 * | 9/2012 | Bradley | B21D 26/14 | 29/419.2 |
| 8,510,924 | B2 * | 8/2013 | Mankame | B23Q 3/086 | 264/230 |
| 8,550,222 | B2 * | 10/2013 | Browne | F16D 28/00 | 188/266.7 |
| 8,608,890 | B2 * | 12/2013 | Everhart | B29C 33/485 | 156/242 |
| 8,734,703 | B2 * | 5/2014 | Havens | B29C 33/485 | 264/313 |
| 8,877,114 | B2 * | 11/2014 | Havens | B29C 33/00 | 264/334 |
| 9,933,663 | B2 * | 4/2018 | Jing | G02F 1/1337 | |
| 2006/0137424 | A1 * | 6/2006 | Browne | B21D 37/01 | 72/377 |
| 2009/0090162 | A1 * | 4/2009 | Bradley | B21D 26/14 | 72/466.8 |
| 2011/0048096 | A1 * | 3/2011 | Bradley | B21D 26/14 | 72/342.94 |
| 2014/0190233 | A1 * | 7/2014 | Ishii | B21D 22/208 | 72/342.2 |
| 2014/0327969 | A1 * | 11/2014 | Huang | B29C 69/02 | 359/620 |

FOREIGN PATENT DOCUMENTS

| | | | |
|---|---|---|---|
| JP | H11-207836 | A | 8/1999 |
| WO | WO 2007/028557 | A1 | 3/2007 |
| WO | WO 2014/135265 | A1 | 9/2014 |

OTHER PUBLICATIONS

Written Opinion dated Jan. 26, 2016 in corresponding PCT International Application No. PCT/EP2015/025075.

* cited by examiner

METHOD FOR PRODUCTION OF A FEMALE EMBOSSING TOOL, A FEMALE EMBOSSING TOOL, AND AN EMBOSSING MODULE EQUIPPED THEREWITH

CROSS-REFERENCE TO RELATED APPLICATIONS

The present application is a 35 U.S.C. §§ 371 national phase conversion of PCT/EP2015/025075, filed Oct. 29, 2105, which claims priority of European Patent Application No. 14003718.5, filed Nov. 10, 2014, the contents of which are incorporated by reference herein. The PCT International Application was published in the French language.

TECHNICAL FIELD

The present invention concerns a method for production of a female embossing tool, a female embossing tool, a pair of embossing tools comprising a male embossing tool and a female embossing tool, and an embossing module for sheet elements intended to form packagings, equipped with a female embossing tool.

TECHNICAL BACKGROUND

A sheet element processing machine, for example a printing, cutting or folding-gluing machine, is used in the packaging industry for example to print, cut or fold-glue sheet elements such as cardboard sheets. These printed sheets are then used to make cardboard boxes.

For example, platen press type machines perform the cutting and embossing, then folder-gluer machines perform the folding and gluing of the cardboard flaps or cut-outs in order to form a packaging. The embossing step imposes a relief on the cardboard sheet for functional reasons and in particular to form pre-folding lines, or for purely aesthetic reasons.

More precisely, the present invention concerns an embossing module equipped with a pair of male and female embossing tools, comprising such a female embossing tool. The invention concerns a method of embossing a cardboard cut-out using such a pair of embossing tools.

STATE OF THE ART

Document EP 0879197 presents an example of a cutting and platen embossing machine. The cutting and embossing tools are inserted in the machine and serve to cut out cardboard sheets.

Document WO 2014/135265 discloses a machine with rotating embossing tools. In this case, the embossing assembly placed in an embossing cassette is equipped with an upper rotating embossing tool positioned parallel to a lower rotating embossing tool. A continuous strip of cardboard is embossed using this cassette.

Document EP 1932657 describes a device for embossing Braille characters on cardboard cut-outs using rotating embossing tools. In this case, the embossing result is a functional relief used for Braille messages on certain packaging boxes, in particular on medicament boxes, to allow tactile reading of the messages.

In all these cases, the male and female embossing tools are produced, in particular by machining, with protuberances on the surface of the male tool and complementary recesses on the surface of the female tool. Consequently, if the manufacturer wishes to produce a small series of such tools, the costs of production of each pair of tools does not allow this at a low cost price for each packaging. Thus, for production of packaging for widely consumed products, because these embossing tools, being custom-made are only affordable for large production series, for example on the order of at least 50,000 to 200,000 boxes. Small series, in particular of the order of or less than a thousand boxes, are only possible for products of high value or in the luxury sector. Furthermore, the tools must be ordered a long time in advance because of the time required for their production.

Moreover, on production of a pair of male and female embossing tools, the manufacturer seeks to obtain the best matching of shape between the protuberances on the surface of the male tool and the recesses on the surface of the female tool, in order to obtain an ideal deformation of the material without squeezing or crushing by excessive reduction of the cardboard thickness, or at least with a minimum of these phenomena.

Also, despite the careful use of the production method for obtaining complementary reliefs between the female embossing tool and the male embossing tool, this good shape matching must be retained after installation of the pair of embossing tools, throughout the very numerous successive movements of either or both embossing tools during production of the packaging.

SUMMARY OF THE INVENTION

One object of the present invention is to provide a method for production of a female embossing tool without limitations of known female embossing tools. Another object of the invention is to increase the flexibility of the production of packaging with different embossing arrangements, in order to be able to produce small or medium quantity series of packagings. Another object of the invention is to provide a means for obtaining a female embossing tool which can be adapted to multiple male embossing tools, in order to avoid producing a complete new tool for each desired modification of relief on the surface of the cardboard.

According to the invention, these aims are achieved by a female embossing tool for sheet elements intended to form packagings, which tool has an outer layer made of a material with shape-memory type properties.

In addition, according to the invention, these objects are also achieved by a method for production of a female embossing tool intended for embossing a sheet element, which comprises the steps of:

- providing a female embossing tool with an outer coating or layer made of a material with shape-memory type properties, and the outer face of the coating or layer has no recesses,
- providing a male embossing tool with an outer face which has at least one protuberance corresponding to at least one desired embossing relief on the sheet element after its embossing, and
- cooperation of the male embossing tool with the female embossing tool such that the outer coating or layer of the female embossing tool undergoes a plastic deformation, which creates at least one recess of a shape complementary to the protuberance(s) on the male embossing tool.

This production method is applied in particular on first use of the female embossing tool or use of a female embossing tool which has already been given an initial starting shape, with its peripheral face free from recesses.

Throughout the description, embossing is defined, in a non-limitative example, as being any operation of mechanical deformation of the sheet element by crushing between a positive form provided with one or more convexities or protuberances, i.e. the male tool, and a negative form provided with one or more concavities or recesses, i.e. the female tool. Embossing may thus be conventional embossing, grooving, creasing or others.

A material with shape-memory type properties is defined, as a non-limitative example, as being a deformable material able to pass from an initial shape to a final shape. The material with shape-memory type properties also has the capacity to recover its initial shape if it is subjected to specific conditions depending on the type of material.

A sheet element is defined, as a non-limitative example, as being an element in the form of a sheet, plate, continuous web, such as of paper, flat cardboard, corrugated cardboard, laminated corrugated cardboard or flexible plastic, for example polyethylene (PE), polyethylene terephthalate (PET), bi-oriented polypropylene (BOPP), other polymers or other materials. The flat support is defined—as a non-limitative example, as being a sheet intended to form a cut-out, then a packaging box after folding-gluing.

In other words, the method herein allows very rapid production of female embossing tools without increasing, more significantly than today, the cost of each packaging relative to large series on the order of several hundred thousand packagings for example.

Furthermore, according to the invention, these objects are also achieved by a method for production of a female embossing tool intended for embossing a sheet element, the method comprising the following steps:

- providing a female embossing tool with an outer layer made of a material with shape-memory type properties, and the outer face of the tool and the outer layer includes at least one recess,
- changing the outer face of the female embossing tool under selected conditions such that the outer face becomes free from recesses again,
- providing a male embossing tool, having an outer face which has at least one protuberance corresponding to at least one desired embossing relief on the sheet element after the embossing,
- cooperation of the male embossing tool with the female embossing tool such that the outer layer and outer face of the female embossing tool undergoes a plastic deformation which creates at least one recess of a shape complementary to at least one protuberance of the male embossing tool.

This production method is applied in particular on the second use or a subsequent use of an embossing tool which initially has a shape corresponding to a prior use, i.e. with a peripheral face provided with recesses.

Preferably, the material is selected from shape-memory metal alloys and polymer materials with shape-memory type properties. For example, the step of bringing the outer face of the female embossing tool under the selected conditions, i.e. transformation, may take place by heating, UV radiation or other methods.

This solution has the advantage, in particular relative to the prior art, of ensuring a very precise and hence particularly strict shape matching between the protuberances of the male embossing tool and the depressions formed by the deformation of the outer face of the female embossing tool.

Thus a custom embossing relief is carried out on the sheet element with the same female embossing tool, wherein in particular the arrangement, shape, length, width, depth of lines, or any other geometric form of grooving or embossing, can be varied.

Also, by production of a single female embossing tool, the packaging manufacturer potentially has an infinite range of possible recesses and hence possible reliefs for the sheet element. Furthermore, the method of production of the female embossing tool is so simple and quick to implement that the global cost price of a pair of embossing tools is reduced roughly by half, and equates essentially only to that price of the male embossing tool, since the same female embossing tool has become adaptable to many configurations.

The present invention also concerns a flat female embossing tool forming a tool for a platen press for the embossing sheet elements intended to form packagings, which comprises a plate with an outer layer made of a shape-memory material.

Also, the present invention concerns a rotating female embossing tool for embossing sheet elements intended to form packagings, which comprises an outer strip or an outer layer made of a shape-memory material.

It is understood that, in effect, this adaptive solution for the female embossing tool can be used both for flat platen press tools and for rotating tools.

Thus the present invention also concerns a pair of embossing tools for embossing a sheet element, such as a cardboard cut-out, comprising a male embossing tool, the outer face of which has protuberances corresponding to desired embossing reliefs on the sheet element after embossing, and a female embossing tool such as one of those defined above, of shape and dimension complementary to and compatible with the male embossing tool.

In general, the present invention also concerns an embossing module which comprises a female embossing tool or a pair of embossing tools. The invention concerns a processing machine for sheet elements intended to form packagings, which comprises a female embossing tool or a pair of embossing tools, or an embossing module, such as those described above. The machine is of the type of a folder-gluer, platen die-cutting press, machine for printing and processing of a continuous web, or others.

BRIEF DESCRIPTION OF THE DRAWINGS

The invention will be better understood and its various advantages and characteristics will appear more clearly from the description below of a non-limitative exemplary embodiment, with reference to the attached diagrammatic drawings in which.

DESCRIPTION OF PREFERRED EMBODIMENTS

Figure 1:
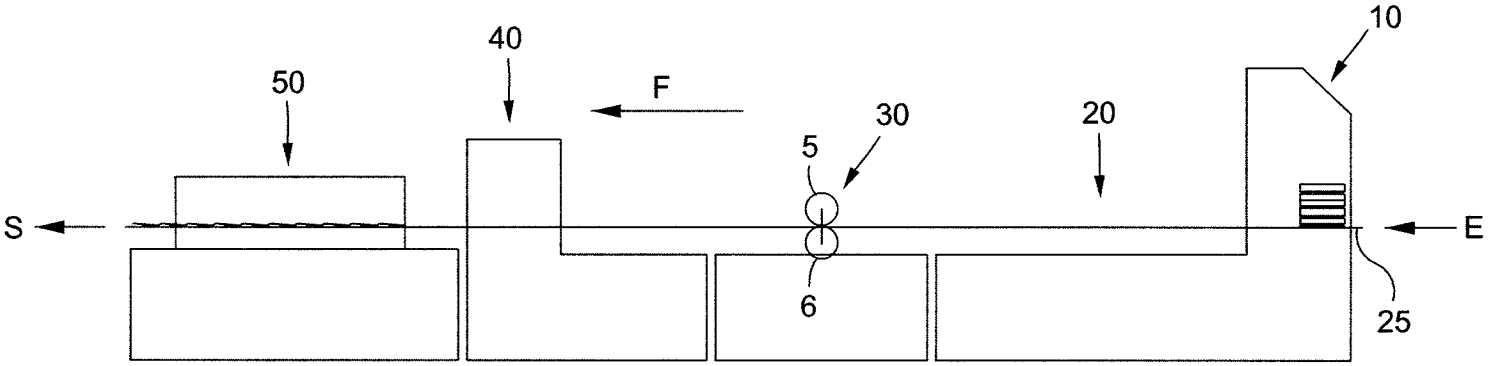
FIG. 1 is a diagrammatic view of a folder-gluer machine viewed from the left side relative to the direction of transport of cardboard cut-outs to be embossed.

FIG. 1 depicts a folder-gluer, illustrating a possible application of the invention. In this example, cardboard cut-outs arrive in the folder-gluer via the inlet E and are discharged in the form of folded boxes at the outlet S, and are processed along the transport path of the cardboard cut-outs. The transport direction is indicated by arrow F. The folder-gluer comprises successively, from the inlet E to the outlet S, a feed station 10, a breaker module 20, a module 30 called the "embossing module", a folding module 40 and a reception station 50.

The function of the embossing module 30 is to mechanically imprint a relief onto the cardboard cut-outs passing through the folder-gluer, by means of the pair of rotating tools 5 and 6. Such relief forms may for example constitute fold lines for future folding at these lines, or Braille characters thus printed, or graphic characters in relief for decorative purposes.

Figure 2:
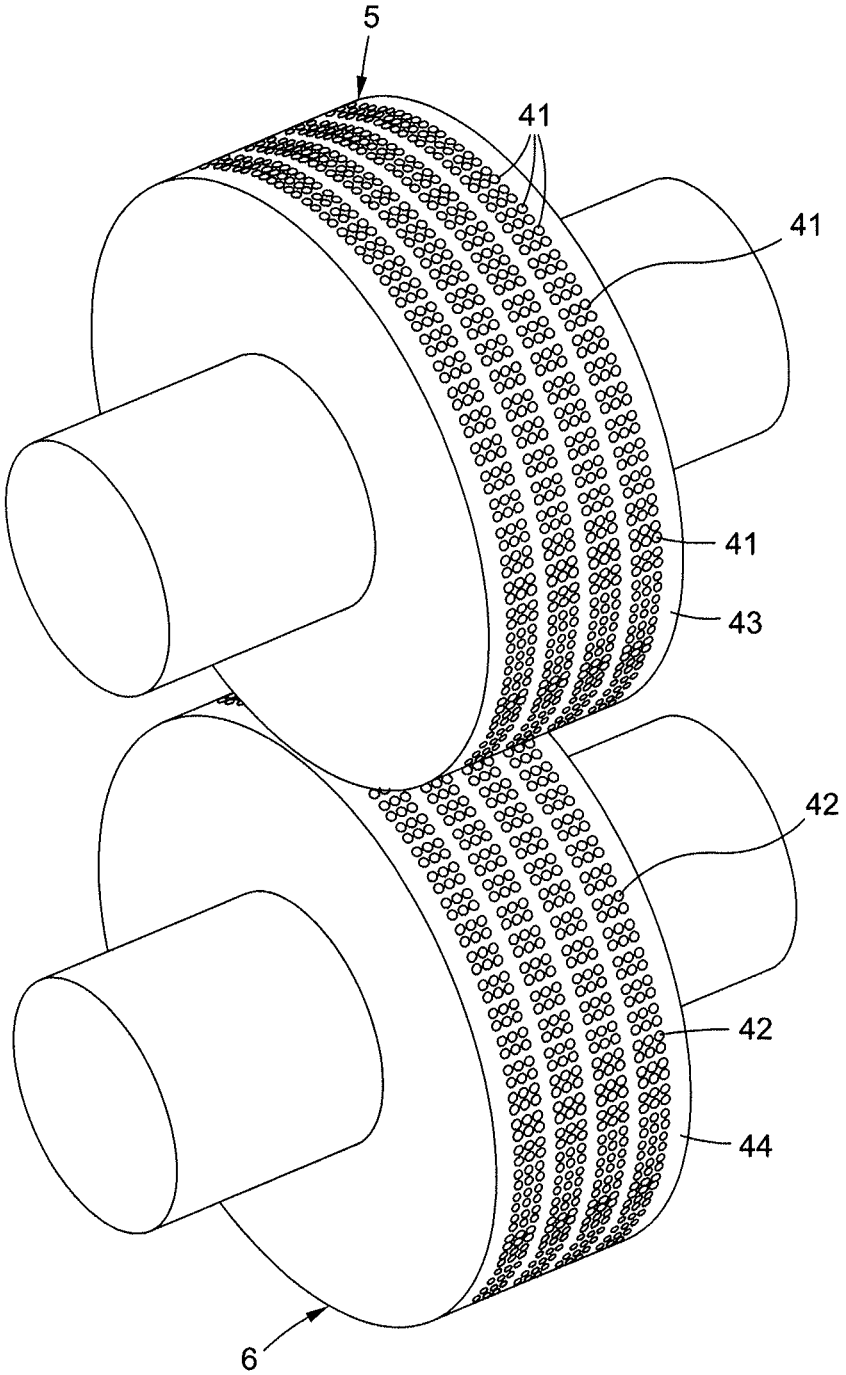
FIG. 2 illustrates an example of a pair of male and female embossing tools, with a female embossing tool produced according to the invention.

FIG. 2 illustrates an example of a pair of tools 5 and 6 according to the invention. The tools 5 and 6 comprise a rotating male embossing tool 5, and a rotating female embossing tool 6. The male tool 5 comprises a cylinder having a peripheral surface which is studded with one or more pins or protuberances 41. The female tool 6 comprises a cylinder having a peripheral surface which is imprinted with recesses or depressions 42. The male embossing tool 5 has a form and dimension and protuberance compatible with the form, dimension, and recesses of the female embossing tool 6. During Braille printing, the pins 41 penetrate into the thickness of the cardboard to form Braille characters.

Advantageously, the pins 41 and the recesses 42 are carried by respective plates 43, 44 in the form of a strip wound around the respective cylindrical tool 5, 6 to form the outer face.

According to the invention, the plate 44 of the female tool 6 is made from shape-memory material.

The material is selected from shape-memory metal alloys, for example type CuAlNi, CuZnAl and NiTi, polymers with shape-memory type properties, for example expanded PVC or TPU, or others.

However, the male tool 5 is still made by means of a metal plate 43 such as a strip or plate of solid steel, machined to produce on its surface the desired protruding relief consisting of dot-like or linear, continuous or discontinuous protuberances of greater or lesser extent, etc.

FIGS. 3 to 10 illustrate the process of production of a first female embossing tool according to the invention, its use for embossing a cardboard cut-out, and the method for production of a second female embossing tool with different relief from the first female embossing tool.

Figure 3:
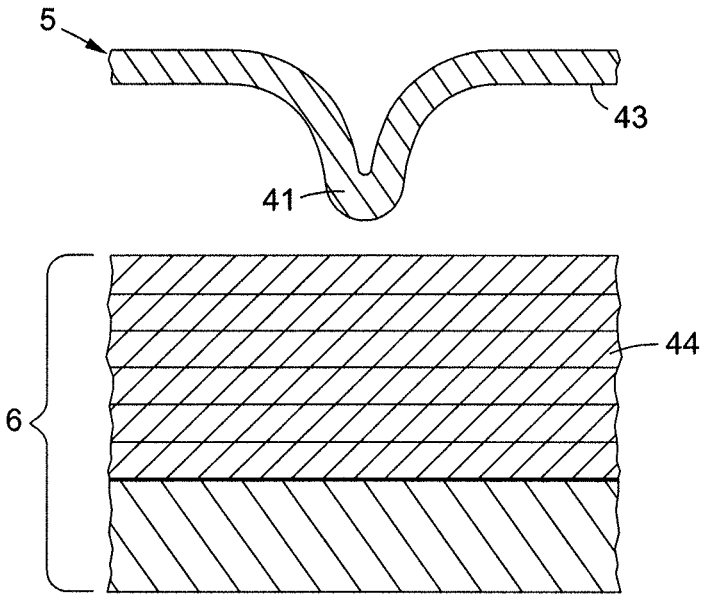
FIGS. 3 to 10 show steps in production of a first female embossing tool according to the invention, its use, then its adaption to another profile in order to produce the second embossing tool which is different from the first embossing tool.
Figure 4:
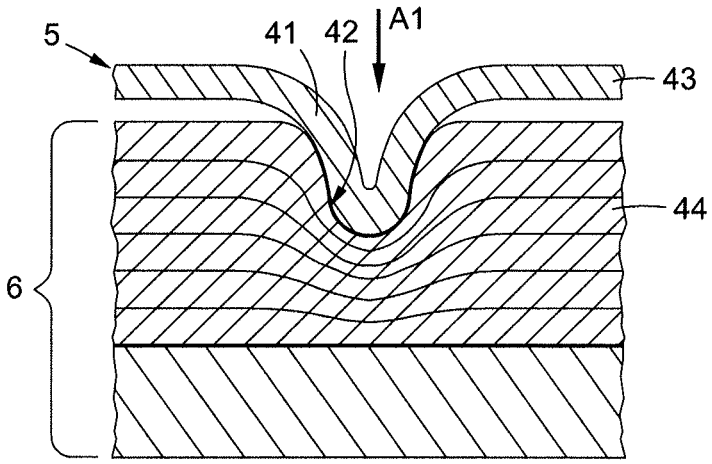
Figure 5:
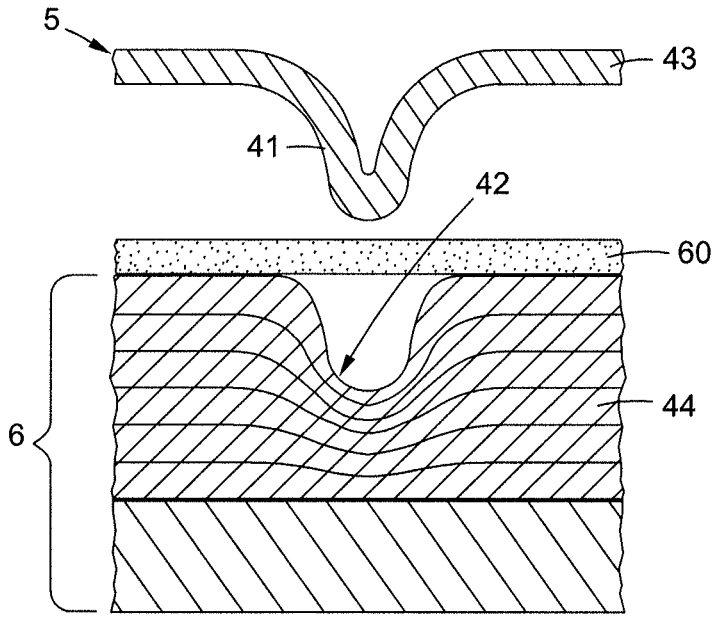
Figure 6:
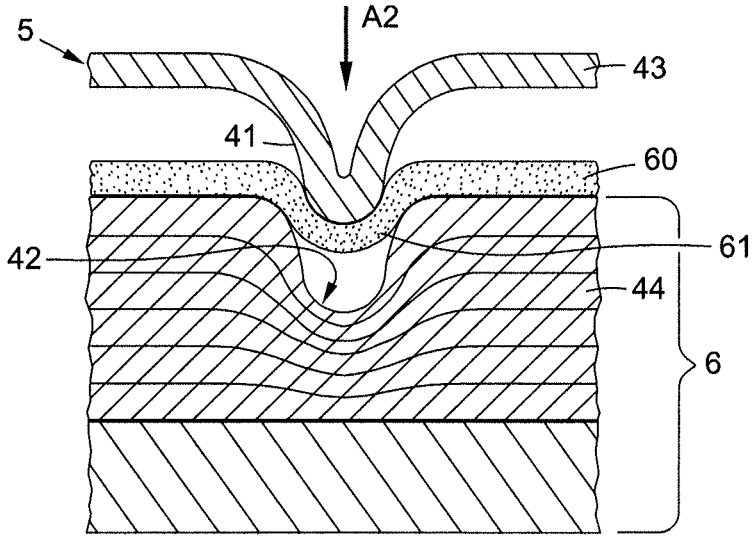

To produce the first female embossing tool, a step comprises providing a first male embossing tool 5, including a plate 43 which defines a first protuberance 41 (FIG. 3). Another step comprises providing a female embossing tool 6 according to the invention, having a plate or outer layer 44 made from shape-memory material. The female embossing tool is shown in FIG. 3 in an undeformed starting shape, indicated by a smooth outer face.

In a second following step (FIG. 4), the plate 43 is brought against the plate 44 (arrow A1), exerting a force such that the protuberance 41 penetrates into the plate 44 and creates a deformation in the form of a depression in the surface and in a portion of the thickness of the plate 44. This relative movement between the plate 43 and plate 44 is performed for example until the plate 43 and the plate 44 make contact on either side of the protuberance 41. By this deformation operation, performed for example at ambient temperature, a depression 42 is formed (FIGS. 4 and 5) in the surface of the female embossing tool 6 which is systematically and precisely complementary in shape to the shape of the protuberance 41 of the male embossing tool 5. The recesses 42 may also be formed under other conditions, depending on the material of the plate 44.

Thus a first female embossing tool 6 is obtained which can now be used as often as required in cooperation with the first male embossing tool 5. Thus by bringing the two tools together (arrow A2) and then by compression of a cardboard cut-out 60 between the first female embossing tool 6, obtained by deformation, and the male embossing tool 5, a cardboard cut-out 60 is embossed and deformed into the shape of an embossment 61 in accordance with FIGS. 5 and 6.

Figure 7:
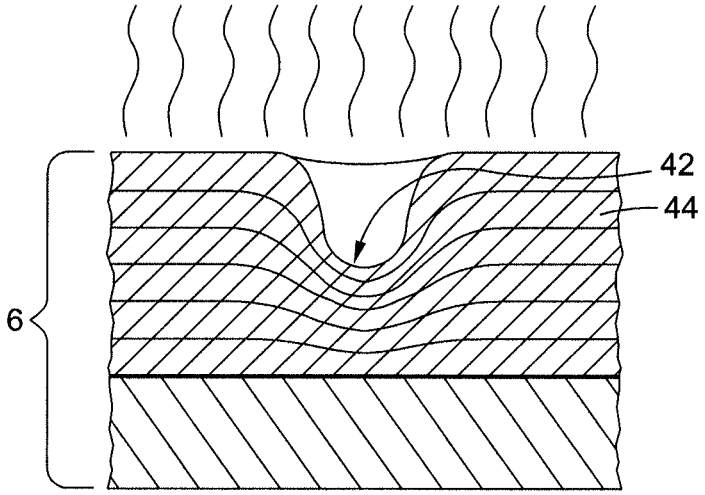
Figure 8:
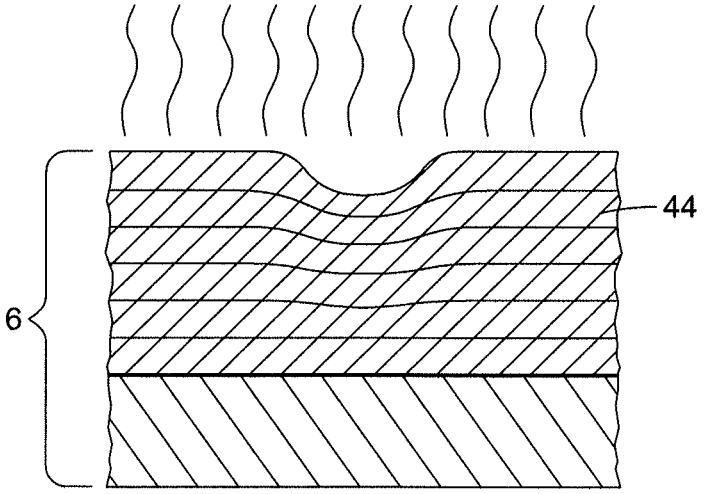

When the embossing operations of the specified series of cardboard cut-outs 60 are complete and it is necessary to switch to embossing another shape, a second female embossing tool is produced by firstly restoring the initial, smooth form of the surface of the plate 44. To this end, as shown in FIGS. 7 and 8, a step comprises bringing the female embossing tool 6 to a temperature high enough to exceed the transformation temperature of the shape-memory material constituting the plate 44. For example, the female embossing tool 6 is placed in an oven heated to this end, after removal of the pair of embossing tools 5 and 6. Application of heat by radiation is also proposed. In this way, the depression 42 is erased since the shape-memory material of the plate 44 resumes its initial form, namely a surface without recesses.

Figure 9:
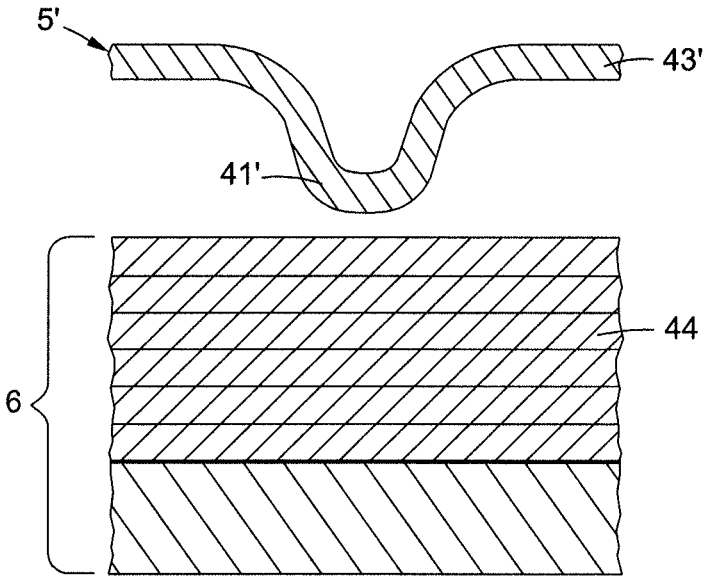
Figure 10:
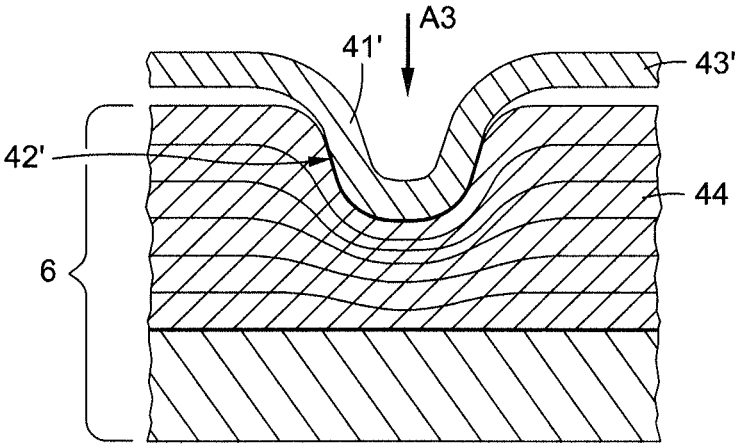

This restoration to the starting form of the female embossing tool 6 allows a new series of deformations of cardboard cut-outs 60 to be applied in another shape and/or another relief. FIGS. 9 and 10 show a method for production of a second female embossing tool according to the invention.

To produce the second female embossing tool, a step comprises providing a second male embossing tool 5', the plate 43' of which defines a second protuberance 41' (FIG. 9) with a different shape from the first protuberance 41 (FIG. 3). Another step comprises providing the female embossing tool 6 resulting from the heating process described above, the plate 44 of which has a smooth outer surface (FIG. 9).

Then, in a supplementary step (FIG. 10), the plate 43' is brought against the plate 44 (arrow A3), exerting a sufficient force for the protuberance 41' to penetrate into the plate 44 and to create a deformation in the form of a depression in the surface and in part of the thickness of the plate 44. This relative movement between the plate 43' and the plate 44 is operated for example until the plate 43' and the plate 44 make contact on either side of the protuberance 41'. By this deformation operation performed at ambient temperature, a depression 42' is formed (FIG. 10) on the surface of the female embossing tool 6 which is systematically and precisely complementary in shape to the shape of the protuberance of the second male embossing tool 5'.

Thus a second female embossing tool 6 is obtained which can now be used as often as required in cooperation with the second male embossing tool 5'.

The invention also concerns a method of embossing a sheet element intended to form a packaging, in which the embossing operation for the sheet element is performed with a pair of embossing tools selected from those described in the present text.

In the embossing methods described above, the sheet element is preferably a cardboard cut-out, either flat cardboard, corrugated cardboard or multi-layer cardboard with flat and corrugated cardboard.

The present invention is not limited to the embodiments described and illustrated. Numerous modifications may be made without leaving the framework defined by the scope of the claims.

The invention claimed is:

1. A method for production of a female embossing tool configured to emboss a sheet element, the method comprising:

providing a female embossing tool with an outer layer comprised of a material with shape-memory type properties, and the outer layer has an outer face having no recess;

providing a male embossing tool, with an outer face which has at least one protuberance corresponding to at least one embossing relief on the sheet element after the sheet element is embossed; and moving the outer face of the female embossing tool and the outer face of the male embossing tool against each other for causing cooperation of the male embossing tool with the female embossing tool such that the outer layer of the female embossing tool undergoes a plastic deformation which creates at least one recess in the outer face of the female embossing tool, the recess of a shape complementary to the at least one protuberance of the male embossing tool.

2. A method according to claim 1, wherein the material of the outer layer of the female embossing tool is at least one of a shape-memory metal alloy.

3. A method according to claim 1, wherein the outer layer of the female embossing tool is a polymer material with shape-memory properties.

4. A method for production of a female embossing tool configured to emboss a sheet element, the method comprising:

providing a female embossing tool with an outer layer comprised of a material with shape-memory type properties, the outer layer having an outer face including at least one recess, processing the outer face of the female embossing tool under selected conditions selected such that the outer face of the outer layer loses the at least one recess;

providing a male embossing tool, with an outer face which has at least one protuberance corresponding to at least one embossing relief to be defined on the sheet element after embossing; and then moving the outer face of the female embossing tool and the outer face of the male embossing tool against each other for causing cooperation of the male embossing tool with the female embossing tool such that the outer layer of the female embossing tool undergoes a plastic deformation which creates at least one recess of a shape complementary to the at least one protuberance of the male embossing tool.

5. A method according to claim 4, wherein the material of the outer layer of the female embossing tool is at least one of a shape-memory metal alloys.

6. A method according to claim 4, wherein the outer layer of the female embossing tool is a polymer material with shape-memory properties.

* * * * *